US005832666A

United States Patent [19]

Flack, II et al.

[11] Patent Number: 5,832,666

[45] Date of Patent: Nov. 10, 1998

[54] WINDOW STORM SHIELD AND GUARD ASSEMBLY

[76] Inventors: Harold Flack, II, R.D. 3 Box 261A; Ryan Stephens, R.R. I Box 272C, both of Dallas, Pa. 18612

[21] Appl. No.: 785,809

[22] Filed: Jan. 9, 1997

[51] Int. Cl.[6] ..... E05B 65/04

[52] U.S. Cl. ..... 49/67; 49/339

[58] Field of Search ..... 49/61, 63, 67, 49/333, 339, 340

[56] References Cited

U.S. PATENT DOCUMENTS

| | | | |
|---|---|---|---|
| 3,878,644 | 4/1975 | Brown et al. | 49/67 |
| 4,555,867 | 12/1985 | Stibolt | 49/67 |
| 4,993,187 | 2/1991 | Schweiss et al. | 49/67 X |
| 5,228,238 | 7/1993 | Fenkell | 49/63 |
| 5,410,841 | 5/1995 | Harris et al. | 49/67 |
| 5,448,856 | 9/1995 | Moore et al. | 49/340 |
| 5,542,215 | 8/1996 | Kubo | 49/67 X |

FOREIGN PATENT DOCUMENTS

| | | | |
|---|---|---|---|
| 486167 | 10/1929 | Germany | 49/67 |

*Primary Examiner*—Jerry Redman

*Attorney, Agent, or Firm*—Michael Ebert

[57] ABSTRACT

A window storm shield and guard assembly installable to fit within the jamb of a building window, or to fit onto the face of the building surrounding the jamb, the assembly, functioning both as a storm barrier to protect the window from strong winds and wind-borne debris, and as a security barrier to deter an intruder from entering the building through the window. The main components of the assembly are a main frame defining a rectangular socket, and a barrier frame which is normally nested in the socket and supports a perforated metal barrier panel that reduces but does not block the passage of light and the flow of air through the panel. The barrier frame is hinged at its upper end to the corresponding end of the main frame, and at its lower end, the barrier frame is latched internally to the corresponding end of the main frame. In the closed mode of the assembly in which the barrier frame is nested in the main frame and is latched thereto, the window is then fully protected. In the open mode of the assembly in which the barrier frame is unlatched and swung up to assume a horizontal position affording emergency access to the window, the barrier frame is then maintained in this position by a pair of cylindrical gas springs, each spring extending between one side of the barrier frame and the corresponding side of the main frame.

9 Claims, 5 Drawing Sheets

WINDOW STORM SHIELD AND GUARD ASSEMBLY

BACKGROUND OF INVENTION

1. Field of Invention

This invention relates generally to window guards, and more particularly to a window storm shield and guard assembly adapted to function both as a storm barrier to protect the window from strong winds and wind-borne debris, and as a security barrier to deter an intruder from entering the building through the window.

2. Status of Prior Art

It is common practice to protect windows of a building, especially those on a ground floor level, from unauthorized entry by means of window guards or grills. Commonly used for this purpose is a guard formed by a framed mesh screen of heavy gauge wire, making it difficult for an intruder to cut the mesh. A wire mesh screen or one made of expanded metal not only prevents intruders from gaining access to the building through the guarded windows, but also serves to shield these windows against breakage.

A permanently-installed window guard has a number of disadvantages. In the event of a fire or other emergency, it is not possible to leave the building through the guarded window. One must therefore find another way to escape, and this may not then be available. Another disadvantage of a framed wire mesh screen is that, the screen may in time become loose or detached from its frame and hence cease to be effective.

Another factor that must be taken into account in window guard design is the extent to which the screen cuts down the amount of light and ventilating air admitted therethrough, as well as the degree to which it reduces visibility. With heavy gauge and relatively thick wire mesh screens, there is a marked reduction in the amount of admitted light and air, and visibility is hindered by the thickness of the screen, particularly when looking through the mesh-guarded window at an oblique angle.

It is also common practice to provide window guards with releasable locking mechanisms which when unlatched permit the screen to be removed or to swing out, thereby permitting exit through the window in case of fire or other emergency.

The ideal locking mechanism for a window guard is one which can be quickly unlatched without difficulty in the event of an emergency, but which when latched makes it very difficult to remove or to swing out the screen, and therefore affords a high degree of security. Prior art locking mechanisms for window guards are either relatively complicated and difficult to release quickly, or of a simple mechanical design that does not offer a high degree of security.

Yet another factor that comes into play when the window guard is of the type in which a screen is supported by a frame attached to the window jamb is that should there exist even a small gap between the screen and the frame, this makes it possible for an intruder to insert a tool in this gap to pry open the screen.

The Pellicore U.S. Pat. No. 2,924,863 shows a window guard for school houses and for other applications in which the guard fits within the window jamb. The window guard comprises a welded steel frame formed of a channel member which supports a woven wire mesh. Also provided is a releasable locking means so that the window guard can be opened quickly in the event of an emergency.

The Levin U.S. Pat. No. 2,711,565 shows a window guard in the form of a main frame secured to the window opening, to which is hinged a closure frame supporting a wire mesh. The Kelly, U.S. Pat. No. 3,087,750, shows a window guard in which a framed woven-wire mesh screen is hinged to the side of a window, a lock being provided. These prior art mesh screen arrangements suffer from many of the drawbacks previously discussed.

The Fernandez U.S. Pat. No. 4,634,157 shows a window guard in which bars are supported by a rectangular frame to provide a guard which presents a prison-like appearance. Also prison-like is the bar assembly shown in U.S. Pat. No. 4,771,574 to Stephens, in which a grid formed by bars is held within a frame. Even more prison-like is the window grill of the Warwick U.S. Pat. No. 4,796,789, which shows a window guard in which a main frame is secured to a window opening to which is hinged an inner frame having a grate attached thereto.

Also of prior art interest is the window guard screen and frame assembly disclosed in the Schweiss et al. U.S. Pat. No. 5,056,262. In this assembly which is installed on the jamb of a window, the window guard takes the form of a perforated metal screen.

Window guards of the type heretofore known, though effective as a security barrier to deter criminals, vandals and unauthorized intruders from gaining access to the guarded window, are less effective as a storm or hurricane barrier. In a severe storm or a hurricane, such as Hurricane Andrew, not only is the window guard subjected to high velocity winds, but it is also assailed by wind-borne debris.

It is for this reason that building codes and insurance regulations now require the use of tough shuttering systems capable of withstanding not only strong winds, but also wind-borne debris. Thus in a typical laboratory test procedure to determine whether a shutter system is acceptable, fired at the shutter under test from a cannon at speeds up to 50 feet per second, is an eight foot long 2"×4" stud weighing 9 pounds. Should the shutter fail this test, it is not acceptable as a hurricane barrier.

SUMMARY OF INVENTION

In view of the foregoing, the main object of this invention is to provide a window storm shield and guard assembly installable to fit within the jamb of a building window or to fit onto the face of the building surrounding the jamb, the assembly being adapted to function not only as a storm barrier to protect the window from strong winds and wind-borne debris, but also as a security barrier to deter unauthorized entry into the building through the window by an intruder.

More particularly, an object of the invention is to provide an assembly of the above type which includes a barrier panel formed of perforated high-strength metal capable of withstanding the forces of wind-blown debris to a degree satisfying the most stringent building code requirements and also serving to block out a substantial percentage of the sun's harmful ultra-violet rays while maintaining adequate air flow when the window is open to ventilate the interior of the building.

Also an object of this invention is to provide an assembly of the above type which is durable, yet has a relatively inconspicuous appearance, for the perforated metal panel exposes the window it protects and acts visually like a curtain scrim which reveals rather than hides the window.

Briefly stated, these objects are attained by a window storm shield and guard assembly installable to fit within the jamb of a building window or to fit onto the face of the building surrounding the jamb, the assembly functioning both as a storm barrier to protect the window from strong winds and wind-borne debris, and as a security barrier to-deter an intruder from entering the building through the window. The main components of the assembly are a main frame defining a rectangular socket, and a barrier frame which is normally nested in the socket and supports a perforated metal barrier panel that reduces but does not block the passage of light and the flow of air through the panel.

The barrier frame is hinged at its upper end to the corresponding end of the main frame and at its lower end it is latched internally to the corresponding end of the main frame. In the closed mode of the assembly in which the barrier frame is nested in the main frame and is latched thereto, the window is then fully protected. In the open mode of the assembly in which the barrier frame is unlatched and swung up to assume a horizontal position affording emergency access to the window, the barrier frame is then maintained in this position by a pair of cylindrical gas springs, each spring extending between one side of the barrier frame and the corresponding side of the main frame.

BRIEF DESCRIPTION OF DRAWINGS

For a better understanding of the invention as well as other objects and further features thereof, reference is made to the following detailed description to be read in conjunction with the accompanying drawing.

DESCRIPTION OF INVENTION

Figure 1:
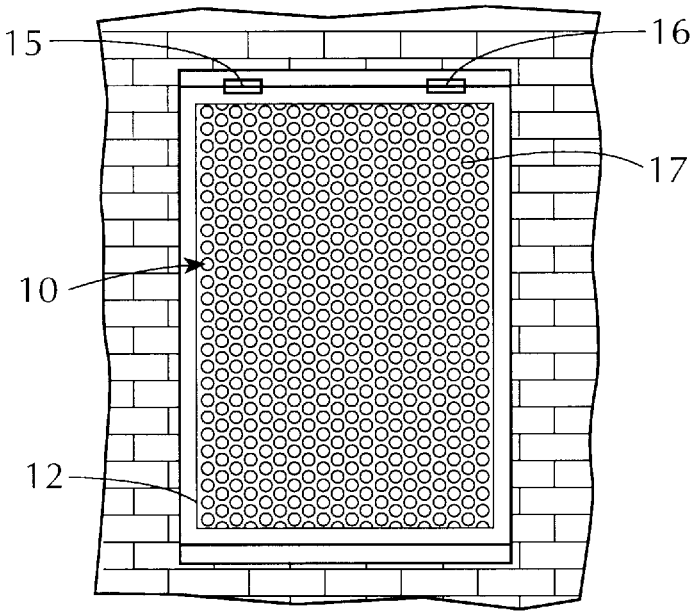
FIG. 1 is a front view of a window storm shield and guard assembly in accordance with the invention installed in a window jamb of a building.

An assembly in accordance with the invention can be installed in either of two ways. In one way which is illustrated in the figures, the assembly generally designated by reference numeral 10 is installed to fit within the jamb of a building window. The other way of installing the assembly is to fit it against the building masonry face surrounding the jamb of the window and attach it thereto.

In either case, the installed assembly functions both as a storm barrier to protect the window from strong winds and wind-borne debris, and as a security barrier to deter an intruder from entering the building.

Figure 2:
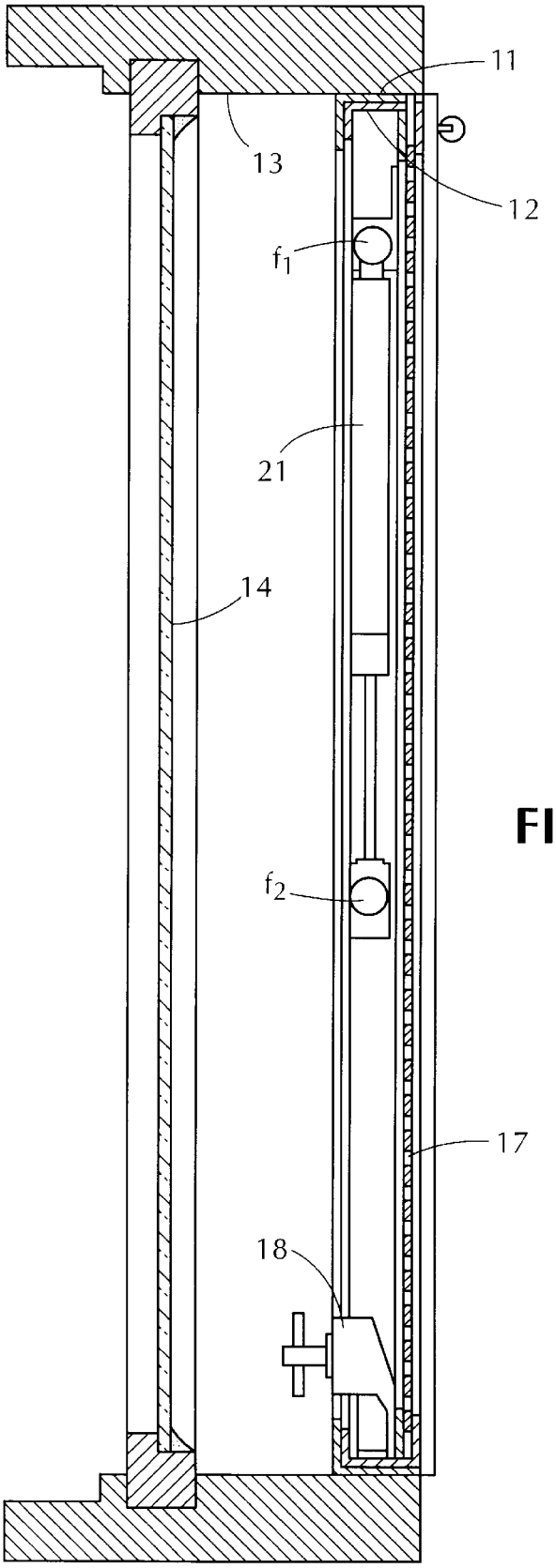
FIG. 2 is a longitudinal section taken through the installation.
Figure 3:
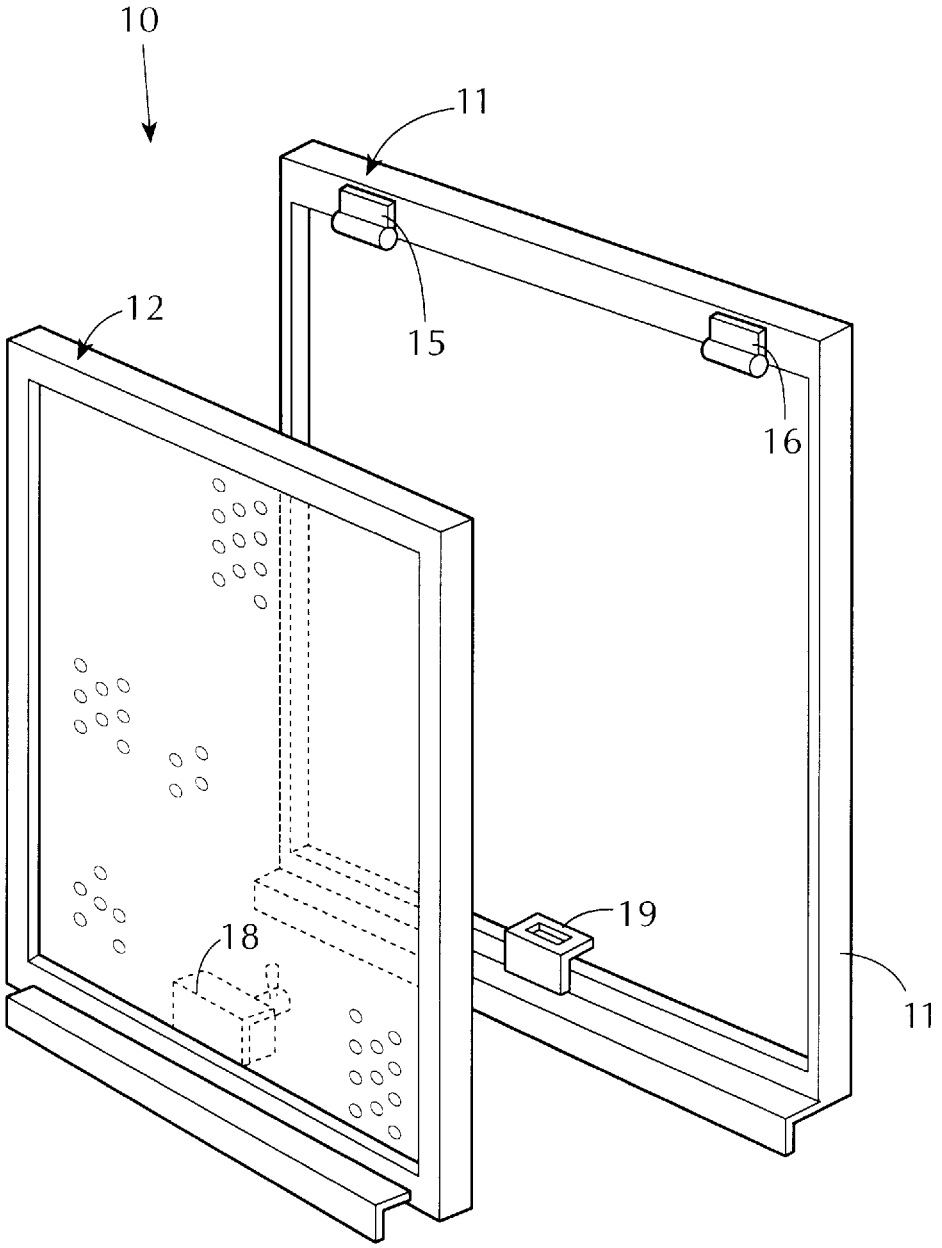
FIG. 3 is an exploded view of the assembly showing its principal components; a main frame and a barrier frame.

FIGS. 1, 2 and 3 show an assembly 10 in accordance with the invention fitted within the jamb 13 of a building window. The main components of the assembly are a main frame 11 and a barrier frame 12. These components are both formed of high-strength, corrosion-resistant metal.

Main frame 11 fits snugly within window jamb 13, and is secured to the jamb by suitable fasteners. Behind jamb 13 is a window 14 which is illustrated as a single pane of glass. However, in practice, the window will be of any conventional type that can be opened or shut.

Figure 6:
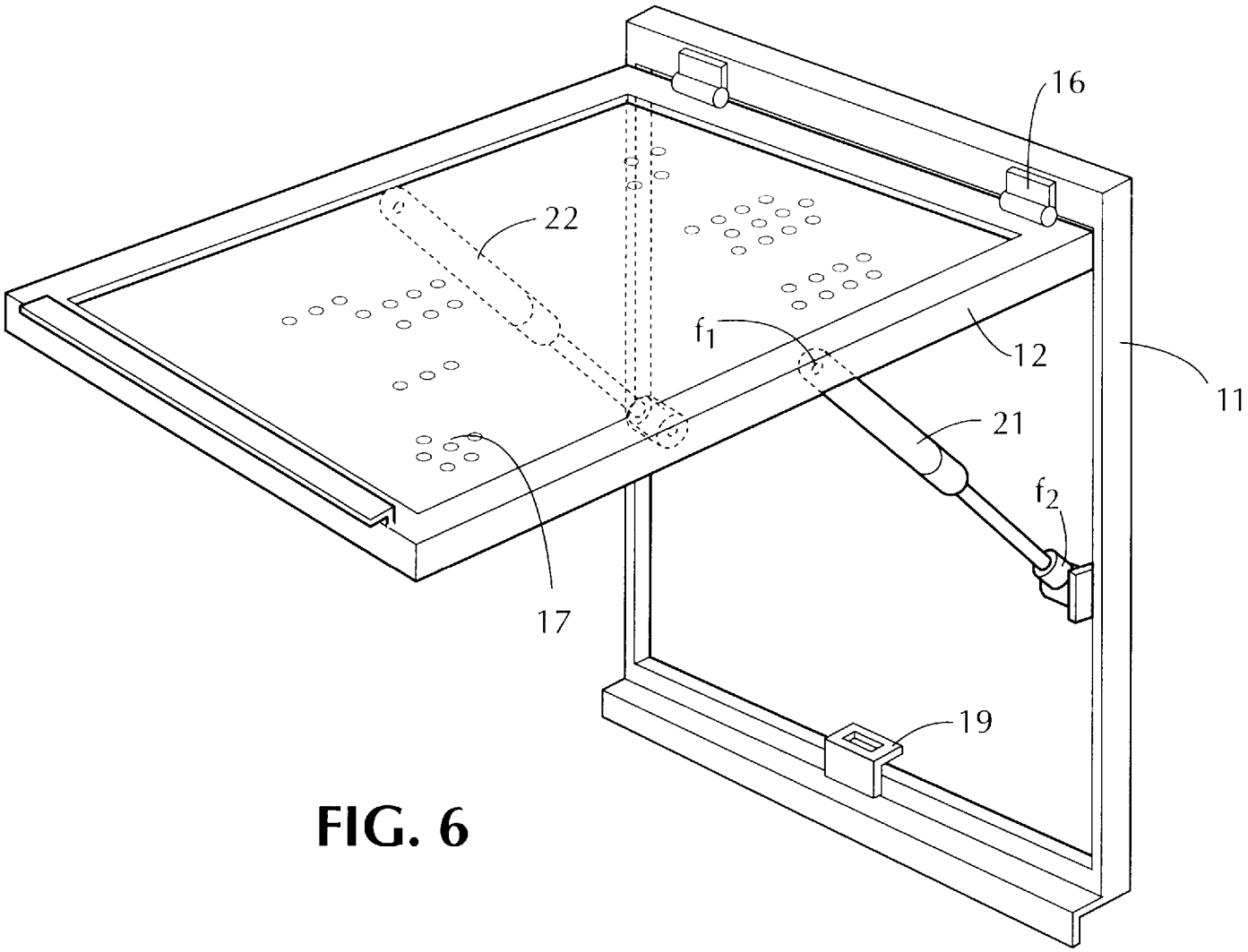
FIG. 6 shows the assembly in its open mode.

Main frame 11 is formed with right angle side walls to define a rectangular socket whose dimensions are such as to neatly nest the rectangular barrier frame 12. Hinges 15 and 16 are attached to the front face at the upper end of main frame 11 and are coupled to the upper end of the barrier frame 12, thereby hinging barrier frame 12 to main frame 11 so that the barrier frame may be swung out of the main frame and raised to a horizontal position in which the barrier frame is normal to the main frame, as shown in FIG. 6.

Figure 4:
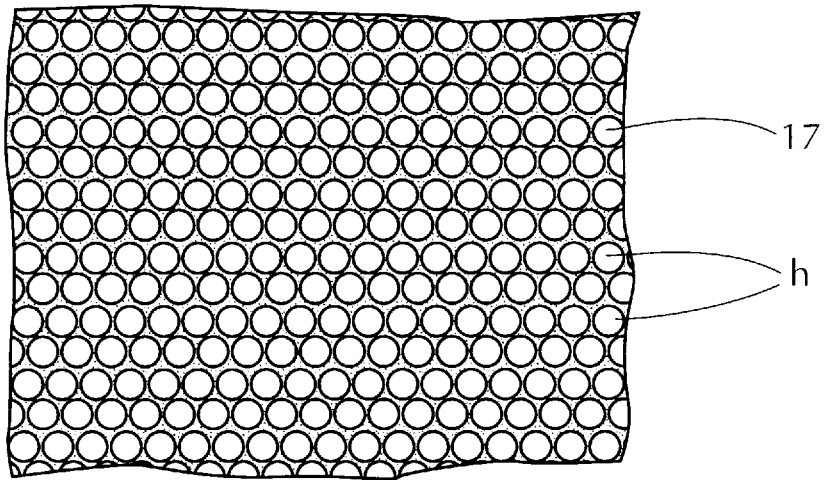
FIG. 4 illustrates the pattern of holes in the perforated panel on the barrier frame.

Supported within barrier frame 12 is a perforated heavy-duty metal panel 17 having circular holes h, as shown separately in FIG. 4. The holes are in a rectangular array pattern in which each horizontal row of holes is staggered 60 degrees with respect to the adjacent row of holes. Hence the arcuate metal lands in the network interconnecting the array of holes are thin so that the perforated panel only serves to somewhat reduce the passage of light and the flow of air through the panel toward the window protected thereby.

Nevertheless the panel acts to shutter out a substantial portion of the sun's harmful ultra-violet rays while maintaining proper air flow and light transmission.

The uniform pattern of circular holes h in the perforated metal barrier panel 17 effectively exposes the window covered thereby in the manner of a scrim curtain. This scrim reduces the illumination of the curtained window without visually blocking the window. Thus when the perforated barrier panel is in place in the closed mode of the assembly, one looking toward the window is scarcely aware of the panel, hence the barrier panel is relatively inconspicuous.

In order for perforated metal panel 17 to function effectively as a storm shield capable of withstanding strong winds of hurricane intensity, as well as debris borne by these winds, it is essential that it has exceptional strength. To this end panel 17 may be made of perforated heavy-duty galvannealed steel or stainless steel. And to render the panel weather resistant, it may be coated with a polyester film. Or a liquid coating may be baked on the panel to enhance its attractiveness.

Mounted on the inner wall of the lower end of barrier frame 12 is a latching mechanism 18 whose latching arm extends laterally from the end of a shaft turnable by a handle. Latching mechanism 18 cooperates with a right angle plate 19 mounted on the lower end of the main frame 11, the plate having a locking slot therein. When the shaft of the latching mechanism is turned, the locking slot in plate 19 then receives the latching arm and latches the barrier frame 12. Barrier frame 12 can only be unlatched from the inside of the assembly by first opening the window protected by the assembly to obtain access to the latching mechanism.

Figure 5:
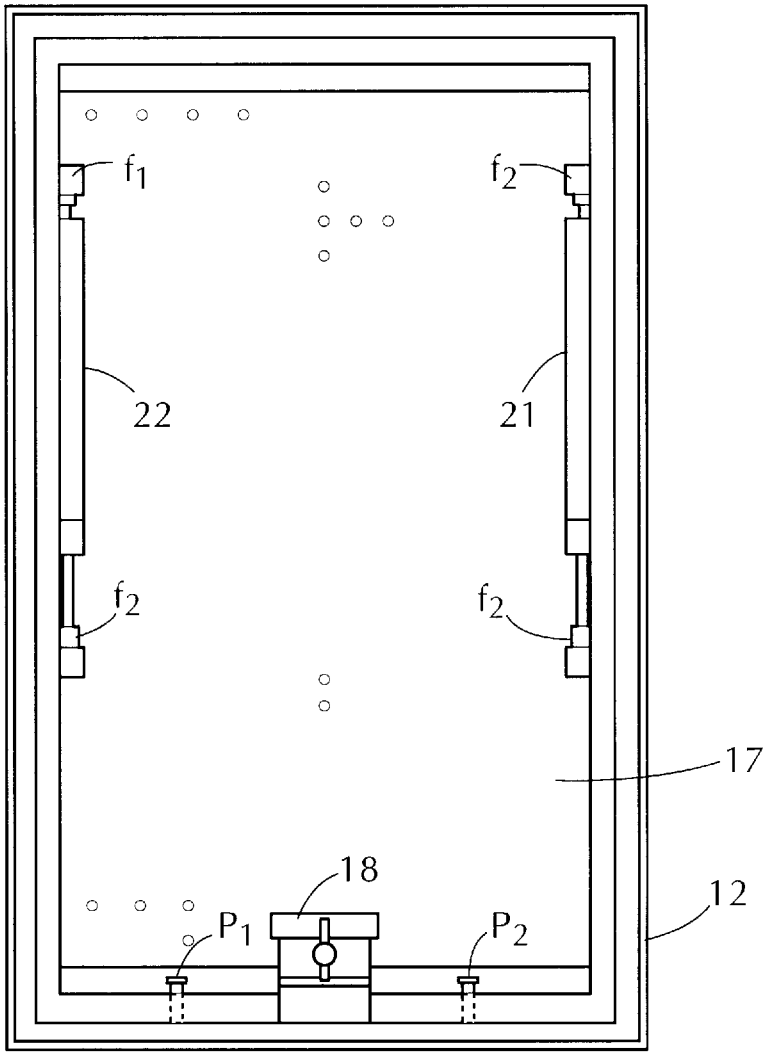
FIG. 5 in a rear view of the assembly in the closed mode.

In the closed mode of the assembly as shown in FIG. 5, barrier frame 12 is nested in the main frame 11 and is latched thereto. To ensure that the barrier frame is not pulled out of the main frame under extremely high wind conditions, removable security pins $P_1$ and $P_2$ are insertable into registered holes in the parallel lower ends of the nested barrier and main frames, each having a finger ring at its end. A similar pair of pins (not shown) are insertable into registered holes in the parallel sides of these frames.

It is necessary that the assembly installed in the window jamb provide access to the window protected thereby so that the outside of the window can be cleaned, or to permit the window to be opened to provide an emergency exit from the building, as in the case of fire. To this end, the assembly is put into an open mode in which as shown in FIG. 6, barrier frame 17 is unlatched from main frame 11 and swung up to a horizontal position to afford full access to the window.

In order to facilitate raising the hinged barrier frame 12 to a horizontal position and to maintain it at this position, there is provided a pair of gas spring 21 and 22, such as those commercially available as SPD gas springs. A gas spring includes a cylinder in which is slidable a piston operated by a shaft extending from one end of the cylinder and having an end fitting attached thereto. When the shaft is pushed in, the piston connected thereto then acts to compress a charge of nitrogen trapped in the cylinder adjacent its other end to which an end fitting is attached. The compressed gas acts as a spring which seeks to push out the piston. Hence the gas spring is extended in length when the shaft is extended and the gas is not compressed, and is short in length when the shaft is retracted and the gas is compressed.

As shown in FIG. 6, the end fitting $F_1$ of gas spring 21 attached to the gas end of the cylinder is joined to one side of barrier frame 12 at an intermediate point thereon, while the end fitting $F_2$ attached to the piston shaft is joined to a point on the corresponding side of the main frame 11. Gas spring 22 is likewise connected to the other side of the barrier frame and the main frame.

Hence in the open mode of the assembly, as shown in FIG. 6, in which barrier frame 12 is swung to a horizontal position, gas springs 21 and 22, which are then fully extended, in combination with the barrier frame and the main frame create a triangular strut to maintain the barrier frame in the horizontal position.

The gas springs serve a dual function. When the barrier frame is swung down from its horizontal position to close the assembly, then as shown in FIG. 5 the piston shafts are retracted into the cylinder to compress the gas therein. The gas springs therefore function to prevent an abrupt swing downward of the barrier frame, for in going from the open mode to the closed mode, one must then compress the gas springs. But when the barrier frame is unlatched and raised to put the assembly in its open mode, the gas springs in which the gas is compressed, then as the springs are released act to assist in raising the barrier frame.

Thus once the assembly is installed in the window jamb of a building and the assembly is latched from the inside, the sealed assembly cannot be unlatched from the outside and an intruder cannot gain access to the window. Nor can he break through the heavy duty perforated metal barrier panel so as to be able to unlatch the barrier frame, for no conventional tool is capable of cutting through this barrier. And the barrier panel, even when assailed by debris borne by winds of hurricane intensity, will withstand this attack.

While there has been shown and described a preferred embodiment of a window storm shield and guard assembly in accordance with the application, it will be appreciated that many changes and modifications may be made therein without, however, departing from the essential spirit thereof.

We claim:

1. A window storm shield and guard assembly installable to fit within a jamb of a building window to function as a storm barrier protecting the window from strong winds and wind-borne debris, and as a security barrier to deter intruders seeking to enter the building through the window; said system comprising:

A. a metal main frame attached to fit within the jamb having right-angle sides and ends defining a rectangular socket;

B. a rectangular metal barrier frame hinged at its upper end to the main frame and fixedly supporting a perforated heavy-duty metal panel, said barrier frame being normally nested within the socket of the main frame whereby the assembly is then in a closed mode in which the perforated metal panel protects the window from wind-borne debris while acting as a scrim to admit light, said hinged barrier frame being swingable to a horizontal position whereby the assembly is then in an open mode in which the window is accessible, C. means inside the assembly to latch the barrier frame to the main frame in the closed mode of the assembly; and D. retractable means to maintain the barrier frame in said horizontal position in the open mode of the assembly.

2. An assembly as set forth in claim 1, in which the main frame, and the barrier frame are each fabricated of high-strength metal.

3. An assembly as set forth in claim 1, in which the perforated metal panel has a rectangular array of holes therein, the holes in each row of the array being staggered 60 degrees with respect to the holes in adjacent rows whereby the metal panel acts as a scrim curtain to reduce an amount of light passing through the metal panel, yet revealing the window protected by the metal panel.

4. An assembly as set forth in claim 3, in which the metal panel is formed of stainless steel.

5. An assembly as set forth in claim 4, in which the metal panel is polyester-coated to render it weather-resistant.

6. An assembly as set forth in claim 1, in which said barrier frame has attached to its lower end at an inside of the frame a latching mechanism having a movable latching arm, and said main frame has attached at a corresponding position to its lower end a plate having a locking slot therein to receive the arm of the latching mechanism.

7. An assembly as set forth in claim 1, further including at least one removable security pin insertable in holes in corresponding sides of the barrier frame and main frame when the barrier frame is nested in the main frame and the holes are then in registration.

8. An assembly as set forth in claim 1, in which said retractable means include a gas spring extending between one side of the barrier frame and the corresponding side of the main frame to maintain the barrier frame at a horizontal position when it is swung-up to said horizontal position.

9. An assembly as set forth in claim 8, in which the gas spring includes a cylinder having a piston slidable therein operated by a shaft which extends from the cylinder and which when pushed in, then advances the piston to compress a charge of gas.

* * * * *